US007651452B2

(12) United States Patent
Weir et al.

(10) Patent No.: US 7,651,452 B2
(45) Date of Patent: Jan. 26, 2010

(54) EXERCISE APPARATUS

(75) Inventors: Ross John Weir, Norwich (GB); Michael Peter Caine, Kenilworth (GB)

(73) Assignee: Progressive Sports Technologies, Ltd. (GB)

( * ) Notice: Subject to any disclaimer, the term of this patent is extended or adjusted under 35 U.S.C. 154(b) by 262 days.

(21) Appl. No.: 11/057,909

(22) Filed: Feb. 15, 2005

(65) Prior Publication Data

US 2005/0148449 A1 Jul. 7, 2005

(51) Int. Cl.
*A63B 26/00* (2006.01)
*A63B 22/04* (2006.01)

(52) U.S. Cl. ..... 482/142; 482/52; 482/908

(58) Field of Classification Search ..... 482/51–52, 482/104, 142, 145, 146, 140, 92–94, 98–103, 482/133–138, 908; D21/686, 690; 5/11, 5/28, 607, 611, 610, 620, 634, 635; 297/69, 297/354.11, 344.12, 377; 601/24, 27; 108/6, 108/9, 19, 35, 116; 248/166, 346.3, 439; *A63B 21/78, A63B 22/04, 26/00*

See application file for complete search history.

(56) References Cited

U.S. PATENT DOCUMENTS

| | | | | |
|---|---|---|---|---|
| 4,635,934 A * | 1/1987 | Roethke | ..... | 482/104 |
| 4,984,785 A | 1/1991 | Wilkinson | ..... | 272/70 |
| 5,433,687 A * | 7/1995 | Hinzman et al. | ..... | 482/104 |
| 5,810,702 A | 9/1998 | Wilkinson | ..... | 482/142 |
| 5,921,897 A | 7/1999 | Stevens | ..... | 482/104 |
| 6,287,243 B1 * | 9/2001 | Isom et al. | ..... | 482/142 |
| 2001/0018387 A1 * | 8/2001 | Webber | ..... | 482/142 |

FOREIGN PATENT DOCUMENTS

| | | |
|---|---|---|
| DE | 34 25 100 | 7/1986 |
| FR | 2 627 090 | 8/1989 |
| GB | 2 361 877 | 11/2001 |

OTHER PUBLICATIONS

Parrillo: the Hardcore Advantage (Exercise Equipment Brochure), Sep. 1995, p. 3; Cincinnati, OH.*

* cited by examiner

*Primary Examiner*—Loan H Thanh
*Assistant Examiner*—Oren Ginsberg
(74) *Attorney, Agent, or Firm*—Renner, Kenner, Greive, Bobak, Taylor & Weber

(57) ABSTRACT

Exercise apparatus (11) has a platform (12) divided into a back-rest element (18) and a seat portion (19). The back-rest element (18) is pivotably mounted in the platform (12) about a pivot point (21). The platform (12) has legs (13, 14) at each end thereof, each said leg (13, 14) having an upper part (22) and a lower part (23) pivotably connected thereto about a further pivot point (25). By varying the position of the back-rest element (18) relative to the platform (12), and the position of the lower leg portions (23) relative to the upper leg portions (22), the exercise apparatus (11) can be made to assume each of a range of configurations comprising bench, step, intermediate incline, high and low seated incline and chair configurations.

12 Claims, 10 Drawing Sheets

31
18
29
11
19
21
28
14
12
13

31
29
18
28
13
11
21
19
14
12

EXERCISE APPARATUS

This invention relates to exercise apparatus. More particularly, it relates to exercise apparatus in the form of an exercise station which is capable of being re-arranged at will to form alternative configurations, thus enabling the performance of a range of different exercises thereon.

The benefits of an exercise station which can be manipulated into a range of different configurations are well known, and are discussed for example in the Applicant's own International Publication No. WO 01/85265. However, until now such multi-configuration exercise apparatus has tended to rely on the inter-engagement of separate component parts to achieve the re-arrangement of the apparatus into its various configurations. This can be rather inconvenient and awkward for the user, and can also give rise to obvious safety implications if the components are not properly connected. Furthermore, such types of exercise apparatus are often constructed so as to be accessible only to users of a "standard" build, and do not cater for those at the large and small ends of the scale.

The present invention seeks to provide an exercise station which may be re-arranged at will into a range of configurations, and which is capable of accommodating users of substantially all shapes and sizes. The particular configurations into which the exercise apparatus of the present invention may be arranged are designated "bench", "chair", "seated incline", "intermediate incline" and "step" configurations, and the present invention will be described herein with particular reference to these configurations, though it is envisaged that the invention may be adapted to encompass other configurations.

The term "bench" is used herein to refer to exercise apparatus comprising a lateral exercise platform of sufficient length and width so as to accommodate the head and body of a user when lying flat thereon, but with his or her legs extending beyond the edge of the platform. The platform should be of sufficient elevation above the ground such that the user when lying in this rest position can with knees bent, place his or her feet flat against the floor. From this rest position the user can then perform a range of exercises with or without simple accessories such as dumb-bells, or bar-bells. Such exercises may include bench presses, shoulder presses, sit-ups, etc.

The term "chair" is used herein to refer to exercise apparatus comprising a seat portion of sufficient elevation above the ground so as to allow the user to sit thereon and with knees bent to place his or her feet flat against the floor, and a back portion of sufficient length so as to support the user's spine when sitting thereon. From this rest position the user can again perform a range of exercises with or without simple accessories such as dumb-bells or bar-bells. Exercises in this position are likely to concentrate on conditioning areas of the upper and lower body, that is to say training those areas either for endurance, power, strength or muscle tone.

The term "seated incline" is used herein to refer to exercise apparatus similar to the chair configuration described above, but wherein the back portion is inclined at a pre-determined angle relative to the platform, rather than being arranged in a substantially upright position as in the chair configuration. This seated incline configuration is again used to perform similar upper body exercises, with the inclined back portion serving to provide increased resistance against gravity.

The seated incline configuration may itself encompass two or more sub-configurations, referred to hereinafter as "low seated incline" and "high seated incline" etc., depending on the angle of the back-rest element.

The term "intermediate incline" is used herein to refer to exercise apparatus similar to the bench configuration described above but with the platform itself inclined at a pre-determined angle. Such apparatus is likely to be used for exercises such as sit-ups etc. to improve the strength of lower body or abdominal muscles, the angle of the incline serving to provide increased resistance against gravity, and the variation of the working angle from the horizontal offering a more comprehensive overall body development programme for the user.

The term "step" is used herein to refer to exercise apparatus, again similar to the bench configuration described above, but with the lateral platform arranged substantially closer to the ground, so that the user can easily step on and off it. This provides a dynamic, total body workout, in contrast to the exercises performed in the other configurations, which will generally target specific muscle groups.

According to the present invention, there is provided exercise apparatus comprising:

- an elongate platform having a surface adapted to accommodate a user lying in a recumbent position thereon;
- legs of adjustable length at or adjacent both ends of the platform surface; and
- a back-rest element pivotally mounted in the platform at a point intermediate its ends, which back-rest element is capable of rotation between a first position wherein it lies flush with the platform surface, and at least one second position wherein it is inclined relative thereto;

and wherein by adjustment of-one or both of the legs and/or rotation of the back-rest element between its first and second positions, the apparatus may be re-arranged at will to form two or more alternative configurations selected from a range comprising bench, chair, seated incline, intermediate incline and step configurations. Preferably, the exercise apparatus according to the present invention will be capable of assuming all five of these configurations.

The exercise apparatus preferably further comprises means for adjusting and retaining the back-rest element in a range of positions between said first and second positions. The back-rest element can thus be raised from its first flat position, in which it will lie when the apparatus is arranged in its bench and step configurations, via one or more transitional positions which define the seated incline configuration(s), to its ultimate second position, which will be utilised when the apparatus is arranged in its chair configuration.

Preferably, when in its second position the back-rest element will be arranged at an angle of substantially 80° relative to the platform, although this may be increased to substantially 90° according to the user's preference. In principle, the back-rest element may be arranged at any of an infinite range of transitional angles between 0° and 90° relative to the exercise platform. In practice however, for the purposes of re-arrangement into the various configurations described herein, it is required only that the range of transitional angles at which the back-rest element may be arranged should comprise angles of substantially 0°, 30° and/or 60°, and 80° and/or 90°.

It will be appreciated that a user leaning against the back-rest element when the apparatus is arranged in its chair or seated incline configurations, will be presented with a working angle supplementary to those recited immediately above. That is to say, when the back-rest element is arranged at an angle of 30° relative to the platform the user is presented with a working angle of 150°, whilst when the back-rest element is arranged at an angle of 80° relative to the platform the user is presented with a working angle of 100°, and so on.

In a currently preferred embodiment of the present invention, the back-rest element is supported by a strut, having one end thereof pivotably connected to the underside of the back-rest element, and the other end of said strut being mounted for sliding motion along a track provided within the platform. The position of the back-rest element is thus varied by sliding the strut along the track.

In order that the above described mechanism is capable of achieving each of the various desired back-rest positions, it is much preferred that the track should have an undulating profile, such that the strut is raised and lowered at certain points thereof. In particular, it is preferred that one end of the track should descend at least partially into the leg adjacent the head of the platform (i.e. distal from the back-rest element's pivot point), whilst a raised portion of the track is preferably provided part-way along the platform.

Whilst the provision of a single strut slideable in a single track is adequate in achieving the required adjustment, for reasons of stability, it is generally preferred that the strut is formed with two supporting members. Each supporting member is preferably mounted in a separate track, said tracks being disposed parallel to one another, one either side of the platform's longitudinal axis.

To ensure that the movement of the two supporting members is synchronised, one or more cross-linking members are preferably provided therebetween.

In order that the back-rest element may be retained in each of the previously-described range of positions, it is preferred that the apparatus is provided with means for retaining the strut in a number of different locations along the or each track.

This may be achieved by the provision of a series of detent positions at selected locations along the track, said detent positions being adapted to receive and retain an end of the strut therein.

Alternatively, or additionally, the strut may be provided with one or more locking pins, adapted to engage with a series of holes provided at selected positions along the or each track. Preferably, the locking pin(s) are controlled by a spring mechanism, activated by means of a handle provided at the head of the platform. Most preferably, the handle controls both the strut locking pin(s) and the engagement of the back-rest element with the platform. In this way, a user may disengage the back-rest element from the platform and rotate it to a desired position in a single action, by means of the handle.

It is further preferred that the strut is provided with a spring-loaded resistance mechanism to prevent unwanted closure of the back-rest element. When returning the back-rest element to its first position, work must therefore be done against the resistance provided by the spring.

This feature reduces the risk of injury to the user, especially the trapping of fingers between the back-rest element and the platform. Additionally, the spring-loaded mechanism gives additional support to the back-rest element, enabling it to resist both compressive and tensile loads. This is desirable as it enables the user to push or pull against the back-rest element during the performance of a range of exercises.

Each leg preferably comprises an upper portion formed integrally with the platform, and a lower portion pivotally connected to the platform. The lower portion of each leg is thus pivotable between a first folded position wherein it lies adjacent the underside of the platform and substantially parallel thereto, and a second unfolded position wherein said lower portion engages with the upper portion of the leg, thereby to increase the length of the leg. The lower portion of each leg and the underside of the platform are preferably shaped such that when said lower portions are arranged in their first folded position, there is provided a gap around at least the edges of the lower leg portions, at the point where they would otherwise contact the underside of the platform, so as to avoid the user's fingers being trapped therebetween.

For the safety of the user, it is also important that there be provided locking means associated with each leg, which locking means enable the lower portions of each leg to be held securely both in their first folded position and in the second unfolded position. The locking means may preferably take the form of a protruding stud provided on one part and a complementary aperture adapted to receive the stud, provided on the other part, said stud and aperture engaging in a snap-fitting arrangement.

For the step configuration, both legs are arranged in the first folded position, whilst for the bench, chair and seated incline configurations, both legs will be arranged in their second fully extended position. For the intermediate incline configuration, one leg is arranged in the first folded position, and the other leg is arranged in the second fully extended position.

Each leg is preferably formed with two surfaces adapted to engage with level ground. This ensures that the exercise apparatus is stable whether both legs are extended, both are folded, or one leg extended and one leg folded.

The apparatus may preferably further comprise one or more channels or notches adapted to receive elastic resistance bands therein, for the performance of certain exercises. Such elastic resistance bands are widely used in commercial and home gymnasiums, and it is envisaged that, in addition to the exercise apparatus according to the present invention being used with or without simple accessories such as dumbbells, wrist-weights, and the like, these bands may also be used in combination therewith. The various positions of the channels or notches, will be determined by the particular exercise schedule associated with each configuration. The use of these elastic resistance bands in combination with the apparatus of the present invention, has the effect of turning the apparatus into an exercise "machine" rather than merely a platform on which exercises may be performed.

The channels or notches are preferably shaped so as to enable the resistance bands to be easily inserted, but also to minimise the risk of inadvertent removal. This may be achieved either by the use of channels or notches having a keyhole-shaped cross-section, or alternatively having a V-shaped neck opening and a T-shaped recess area.

As mentioned above, the present invention has been developed so as to meet the needs of substantially all sizes (heights) of user. Specifically, the preferred dimensions of the apparatus have been developed to accommodate all but the smallest 5% of the female population, and all but the largest 5% of the male population, based on national average heights for the United Kingdom.

The optimum length of the platform is determined by the largest target user. Support is required from the back of the head down to the base of the pelvis, however any excess platform length will not detrimentally affect the exercise position of the smallest target user. In the development of the present invention it has been found that the preferred platform length is at least 1000 mm.

The preferred length of the back-rest element is again determined by the largest target user, as the neck and shoulder area must be supported. Again, any excess length will not detrimentally affect the exercise position of smaller users. Preferably therefore, the back-rest element has a length of at least 720 mm.

So far as the optimum height of the bench is concerned (i.e. the height of the exercise platform above the ground when both legs are fully extended), this dimension is determined by the smallest target user. This is because too large a height could result in contraindicative hip angles and hyperextension of the lumbar spine in smaller users, whilst conversely, taller users can safely accommodate a lower platform height than might otherwise be ideal for them. It has therefore been found that when both legs of the exercise apparatus are in their fully-extended position, the platform should preferably have a height of not more than 350 mm from the ground.

The height of the platform above the ground when the exercise apparatus is in its step configuration (i.e. when both legs are folded) is again determined by the smallest target user, and is preferably substantially 200 mm from the ground.

The width of the exercise platform and of the back-rest element is preferably substantially 350 mm. When the exercise apparatus is arranged in its bench, chair, seated incline and intermediate incline configurations, this dimension is small enough to allow for safe and comfortable rotation of the shoulders for the smallest target user, but is also large enough to provide enough back support for the largest target user. When arranged in the step configuration, this optimum width ensures that the exercise platform is wide enough to safely accommodate the length of the user's foot thereon.

It is further preferred that the edges of the exercise apparatus, particularly the edges of the exercise platform and the back-rest portion, should be formed as rounded corners having a large radius of curvature. The large radius of the side edges of the platform allow for enhanced mobility e.g. of the shoulders when using the apparatus in the bench or chair configurations. The curved edges also ensure a correct wrist position, when performing press-ups, tricep dips, and other "hands-on" exercises when the apparatus is in the bench position, thus avoiding hyper-extension and so helping to prevent injury to the user.

The end edges of the exercise platform, adjacent the junction of the platform and the legs, are preferably also formed with a large radius of curvature. When the apparatus is arranged in its bench or step configurations, this enables the user safely to perform calf-raise exercises thereon.

The working surfaces of the platform are preferably provided with a coating having a high coefficient of friction, low thermal conductivity, and relatively high compressibility. This combination of characteristics ensure that the working surfaces have good anti-slip properties, and are also comfortable to sit or lie upon.

The exercise apparatus may preferably further comprise a storage compartment housed within the platform, and accessible by rotating the back-rest element into its second position. The back-rest element therefore also acts as a lid for the storage compartment.

The storage compartment is preferably of a suitable size and shape so as to enable it to accommodate therein a range of fitness accessories for use with the exercise apparatus. Such fitness accessories might for example include hand-weights (dumb-bells), resistance bands and fitness gloves.

In order that the present invention may be fully understood, a preferred embodiment will now be described in detail, though only by way of example, with reference to the accompanying drawings in which.

Figure 17:
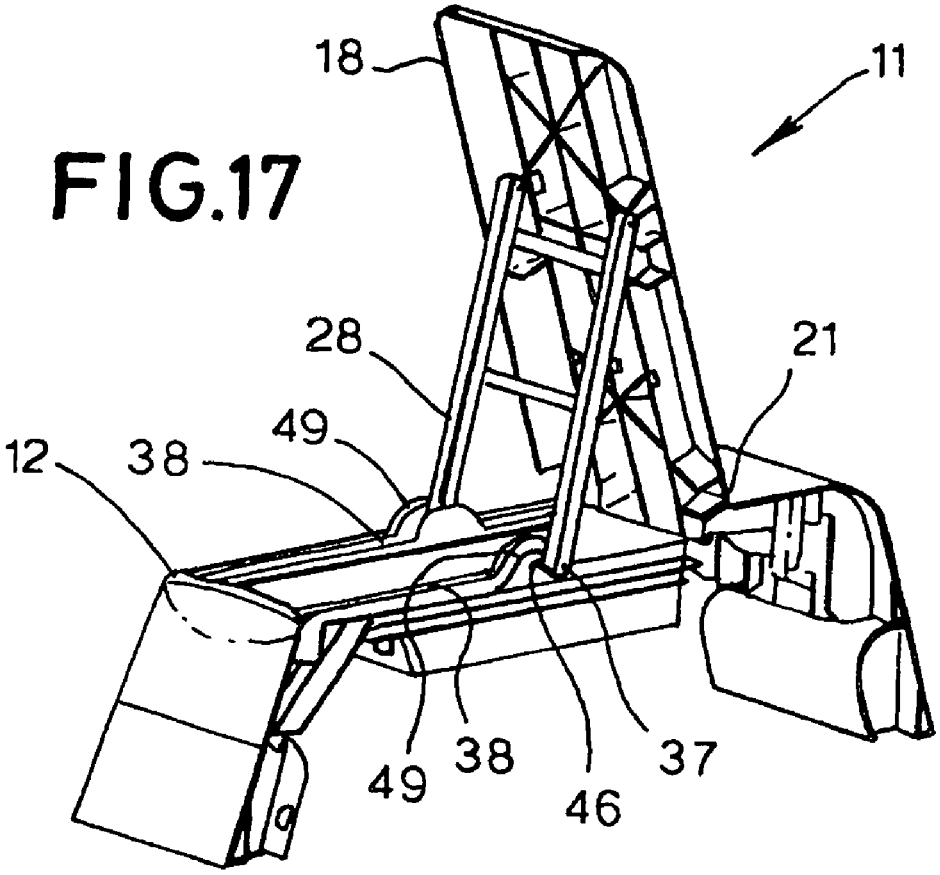
Figure 18:
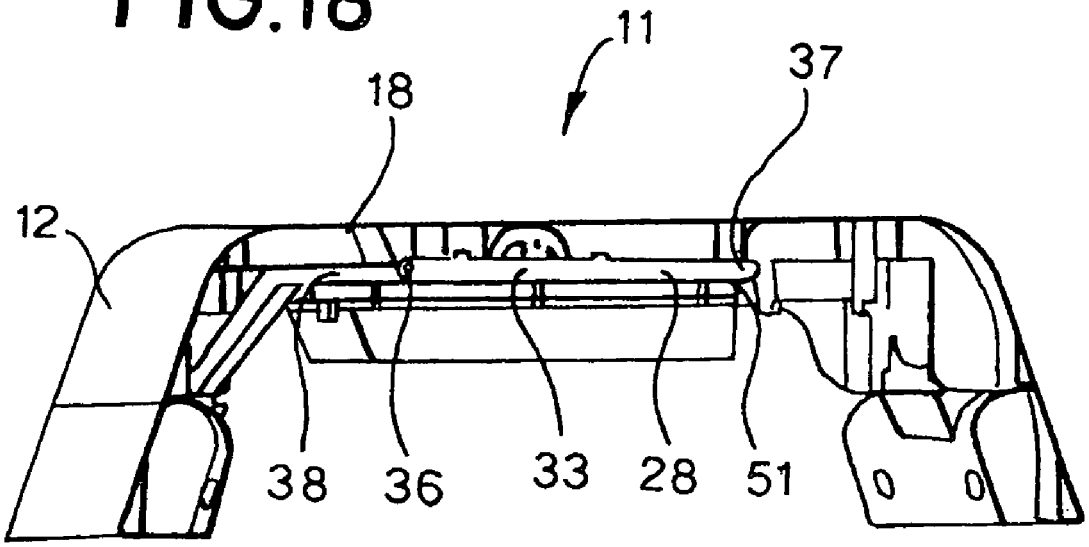
Figure 19:
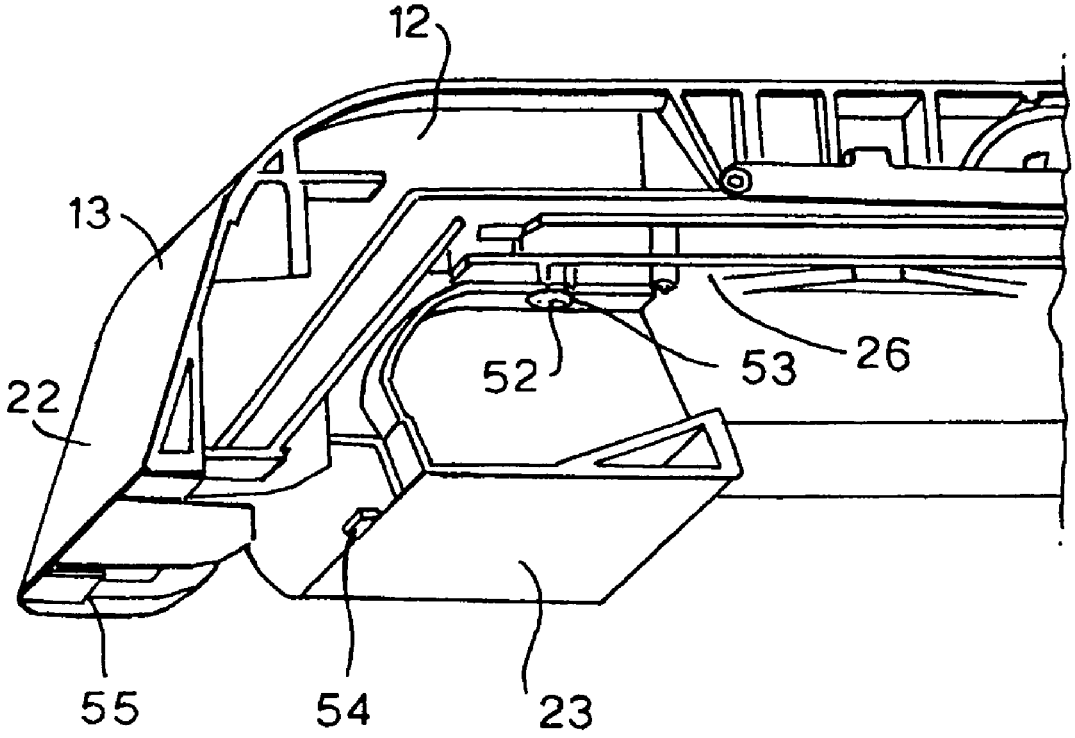

FIGS. 15 to 18 are a series of partially cut-away perspective views, shown an illustrative sequence in which the exercise apparatus is varied from a low seated incline to a high seated incline, then to its chair configuration, and finally to its bench configuration; and FIG. 19 is an enlarged, partially cut-away perspective view showing a leg of the exercise apparatus in its folded position, as in FIGS. 3, 4, 11 and 12.

Figure 1:
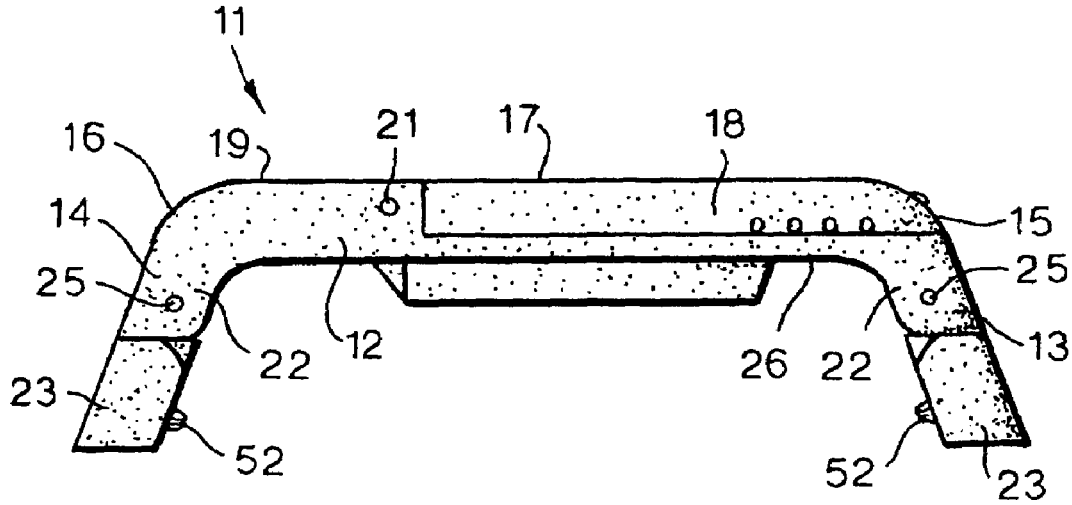
FIG. 1 shows a side view of a preferred embodiment of exercise apparatus according to the present invention, when arranged in its bench configuration.
Figure 2:
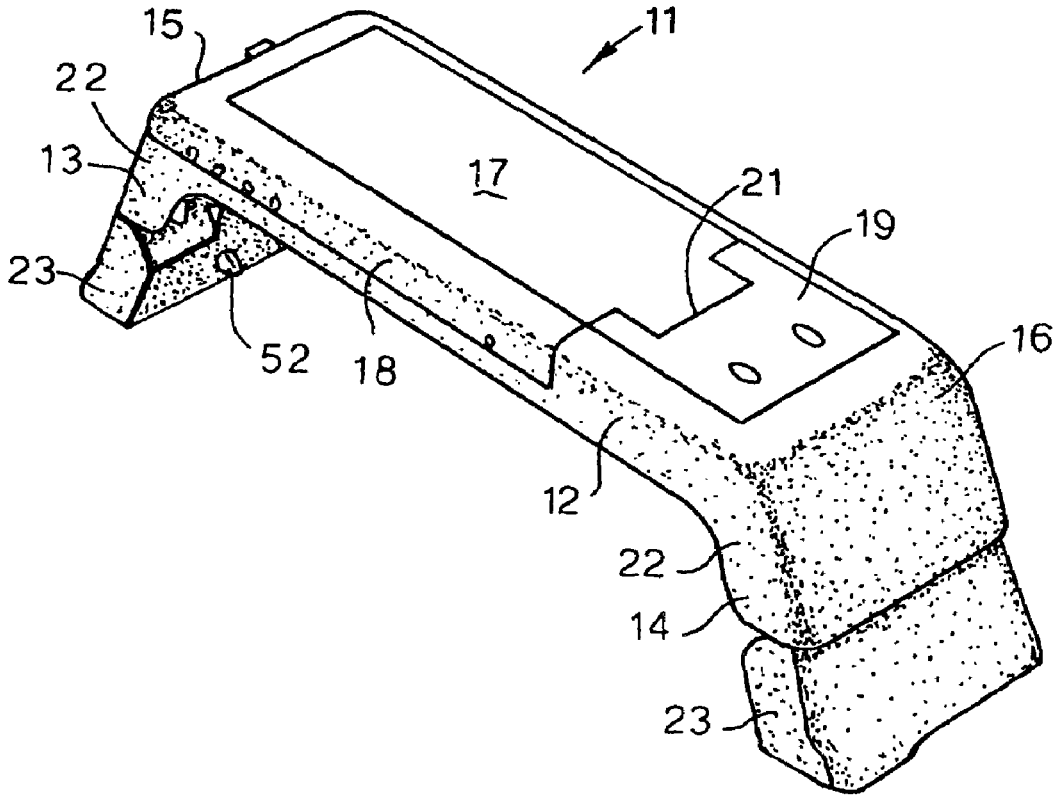
FIG. 2 shows a perspective view of the exercise apparatus arranged in its bench configuration, as in FIG. 1.

Referring first to FIGS. 1 and 2, there is shown exercise apparatus, generally indicated 11, comprising a lateral platform 12 having first and second legs 13, 14 extending respectively from the head and foot 15, 16 of the platform 12. The intersection between the platform 12 and the first and second legs 13, 14 at the head and foot 15, 16 respectively are in the form of smoothly rounded corners having a large radius of curvature, as also are the side edges of the exercise platform 12. The upper surface 17 of the platform 12 is adapted to accommodate a user (not shown) lying thereon, with his or her head oriented towards the head 15 of the platform 12, and the base of his or her pelvis situated closely adjacent the foot 16 of the platform 12.

The upper surface 17 of the platform is divided into a back-rest element 18 and a seat portion 19 located towards the foot 16 of the platform 12. The back-rest element 18 is pivotally mounted in the platform 12 at a point 21 adjacent the boundary of the seat portion 19. The back-rest element 18 is capable of rotation about the pivot point 21, between a first position wherein the back-rest element 18 lies flush with the platform 12, and further positions wherein it is arranged at an angle relative thereto, as will be described in more detail below with particular reference to FIGS. 5 to 10, and 15 to 18.

The legs 13, 14 are each comprised of an upper portion 22, formed integrally with the platform 12, and a lower portion 23. The lower portion 23 of each leg 13, 14 is pivotably connected to the platform 12 at a pivot point 25, adjacent the intersection between the platform 12 and the upper portion 22 of each leg. The lower portion 23 of each leg 13, 14 is capable of rotation about the pivot points 25 between a first folded position wherein said lower portions 23 lie adjacent and parallel to the underside 26 of the platform 12, as will be described in more detail below, with particular reference to FIGS. 3, 4, 11 and 12, and a second extended position, wherein the lower portions 23 engage with the upper portions 22 of the legs 13, 14, thereby to effectively increase the length of the legs 13, 14. Fastening means are provided to secure the lower leg portions 23 in each of their positions, as will be described in more detail below with reference to FIG. 19.

The exercise apparatus 11 as shown in FIGS. 1 and 2, is arranged with the back-rest element 18 in its first position, lying flush with the platform 12, and with the lower portions 23 of each leg 13, 14 arranged in their second extended position, to engage with their corresponding upper portions 22. The apparatus 11 is thus arranged in the bench configuration.

Figure 3:
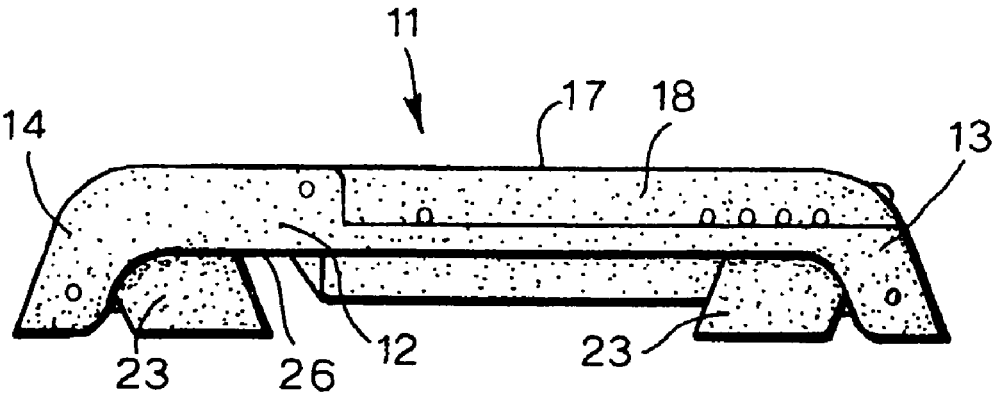
FIG. 3 shows a side view of the exercise apparatus of FIGS. 1 and 2, when arranged in its step configuration.
Figure 4:
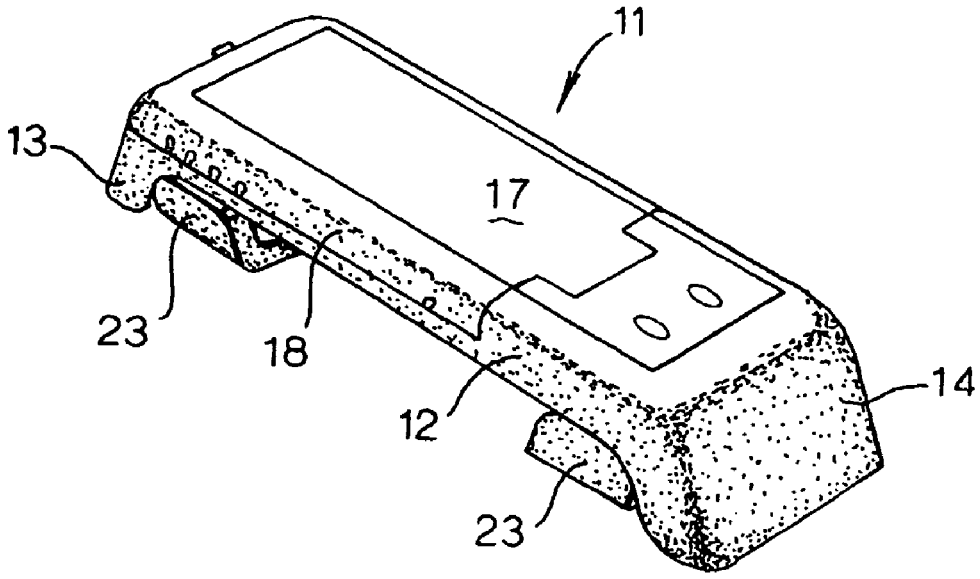
FIG. 4 shows a perspective view of the exercise apparatus arranged in its step configuration, as in FIG. 3.

Referring now to FIGS. 3 and 4, there is shown the same exercise apparatus 11 of FIGS. 1 and 2, but here shown arranged in the step configuration. This configuration requires the back-rest element 18 to lie in its first position, flush with the platform 12, as with the bench configuration described above. However, in order to bring the platform surface 17 substantially closer to the ground so as to enable the performance of so-called "step aerobics" exercises thereon, the lower portions 23 of the legs 13, 14 must be arranged in their first folded position.

Starting from the bench configuration as shown in FIGS. 1 and 2, this is achieved by unfastening the lower portions 23 of the legs 13, 14 from their respective upper portions 22, and folding them inwards to lie alongside the underside 26 of the platform 12.

Figure 5:
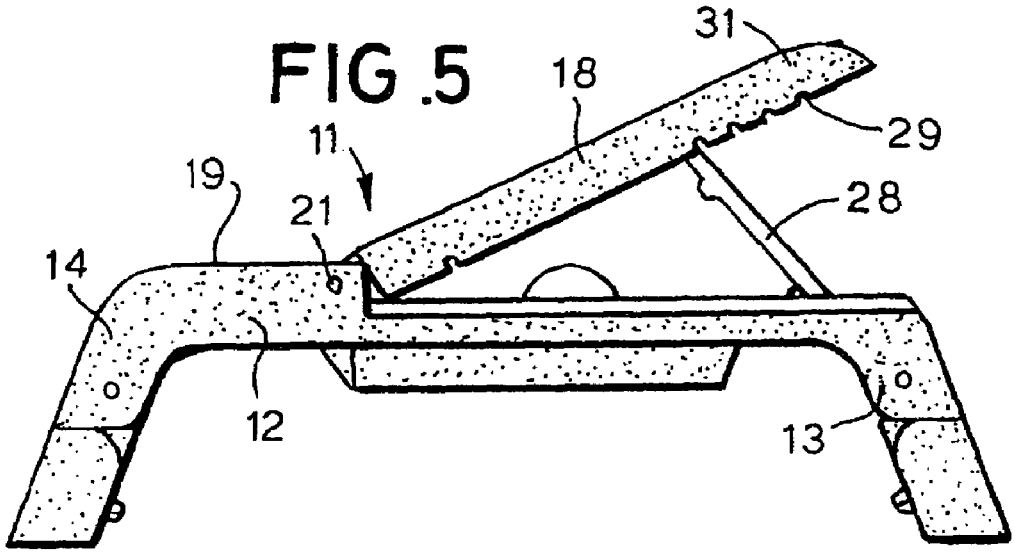
FIG. 5 shows a side view of the exercise apparatus of FIGS. 1 to 4, when arranged in a low seated incline configuration.
Figure 6:
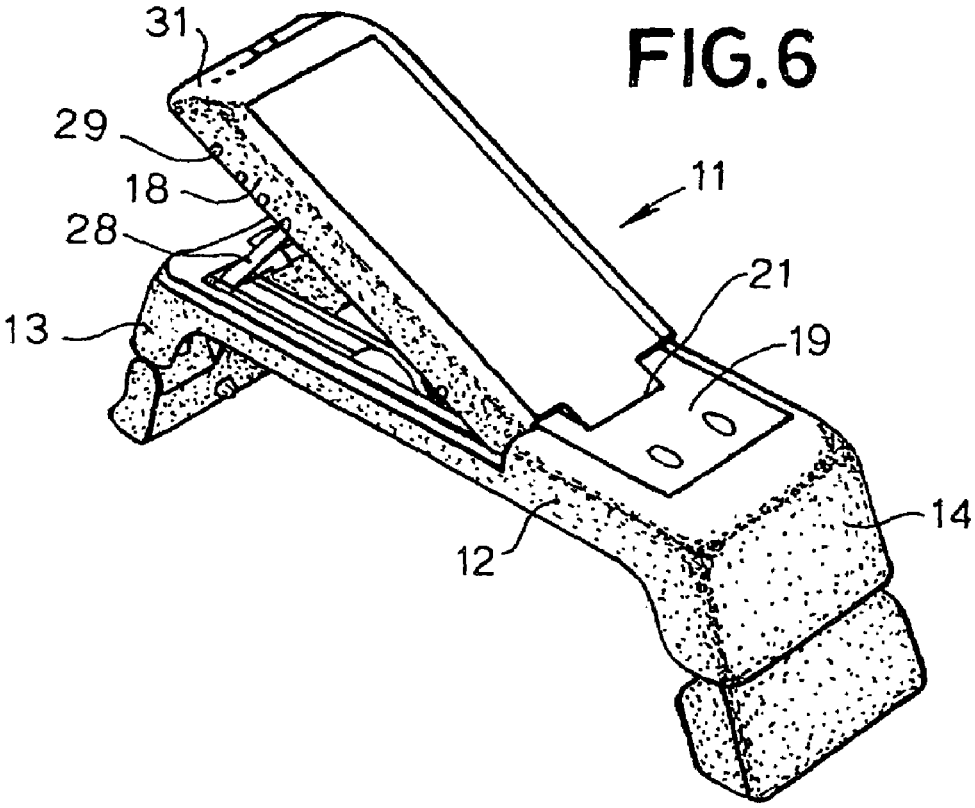
FIG. 6 shows a perspective view of the exercise apparatus arranged in a low seated incline configuration, as in FIG. 5.

Referring now to FIGS. 5 and 6, there is shown the same exercise apparatus 11 as in FIGS. 1 to 4, but now arranged in a low seated incline configuration. This configuration requires the legs 13, 14 to be fully extended, as in the bench configuration described above with reference to FIGS. 1 and 2. However, the back-rest element 18 is now partially rotated about its pivot point 21 so as to be inclined at an angle of substantially 30° relative to the platform 12. A strut 28 is provided between the back-rest element 18 and the platform 12, which strut 28 acts to retain the back-rest element 18 at the desired angle, and also to control the movement of the back-rest element 18 from one position to another. The strut 28 and the mechanism associated therewith will be discussed in more detail below with particular reference to FIGS. 13 to 18.

With the exercise apparatus 11 arranged in the low seated incline configuration, as illustrated in FIGS. 5 and 6, the user (not shown) may sit on the seat portion 19, reclining against the back-rest element 18. From this position, he or she may carry out exercises with hand-held weights, or alternatively may use elastic resistance bands (not shown). Channels 29 for receiving these bands are provided along the edge of the back-rest element 18, and may also be provided at other locations on the apparatus 11. Towards the upper end 31 of the back-rest element 18, several such channels 29 are provided at spaced intervals, to cater for users of varying height. It is also envisaged that the channels 29 might be adapted such that the elastic resistance bands and other accessories can be slidably moved from one position to another.

Figure 7:
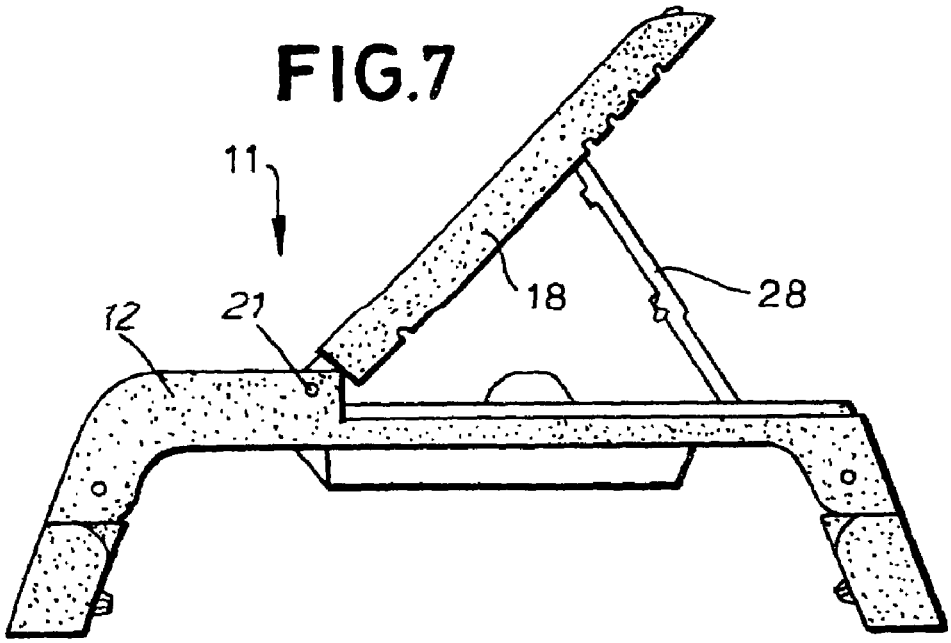
FIG. 7 shows a side view of the exercise apparatus of FIGS. 1 to 6, when arranged in a high seated incline configuration.
Figure 8:
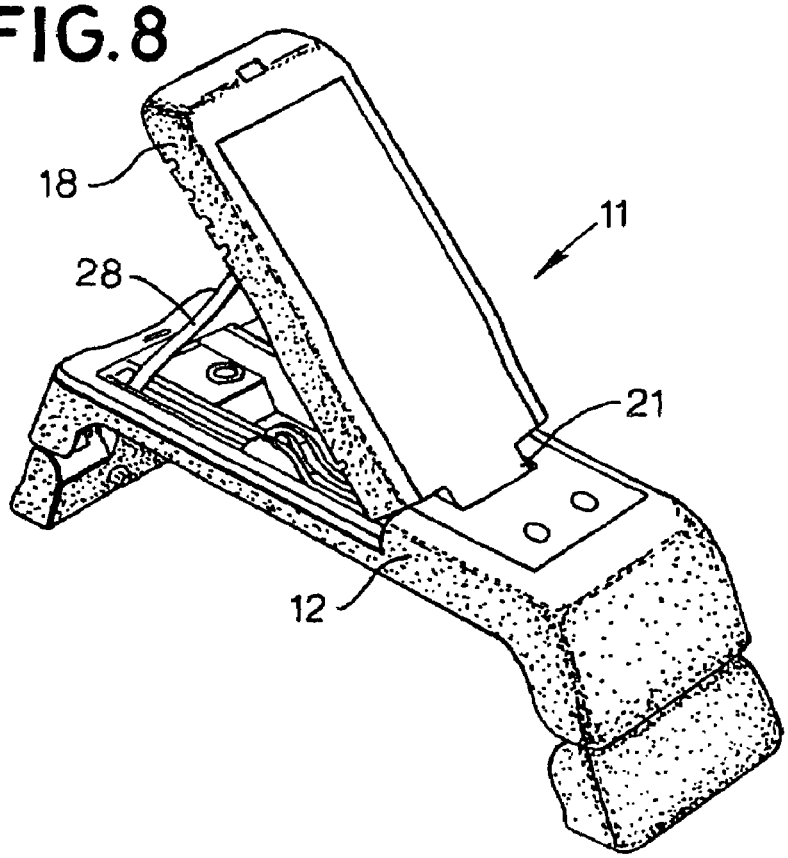
FIG. 8 shows a perspective view of the exercise apparatus arranged in a high seated incline configuration, as in FIG. 7.

Referring now to FIGS. 7 and 8, there is shown the same exercise apparatus 11, as described above with reference to FIGS. 1 to 6, but now arranged in a high seated incline configuration. This configuration is essentially identical to the low seated incline configuration described above with reference to FIGS. 5 and 6, except that the back-rest element 18 is rotated further about its pivot point 21 so as to be inclined at an angle of substantially 60° relative to the platform 12. The user (not shown) is therefore presented with a different working angle from that provided by the low seated incline configuration. It will be noted that the position of the strut 28 relative to the platform 12 is also different to that shown in FIGS. 5 and 6.

Figure 9:
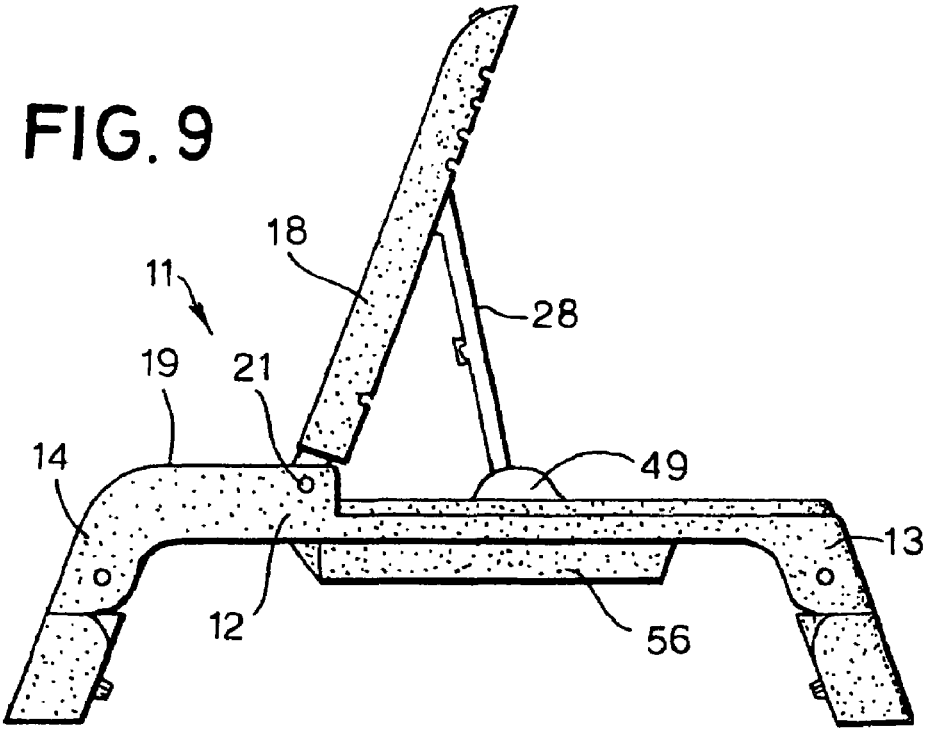
FIG. 9 shows a side view of the exercise apparatus of FIGS. 1 to 8, when arranged in its chair configuration.
Figure 10:
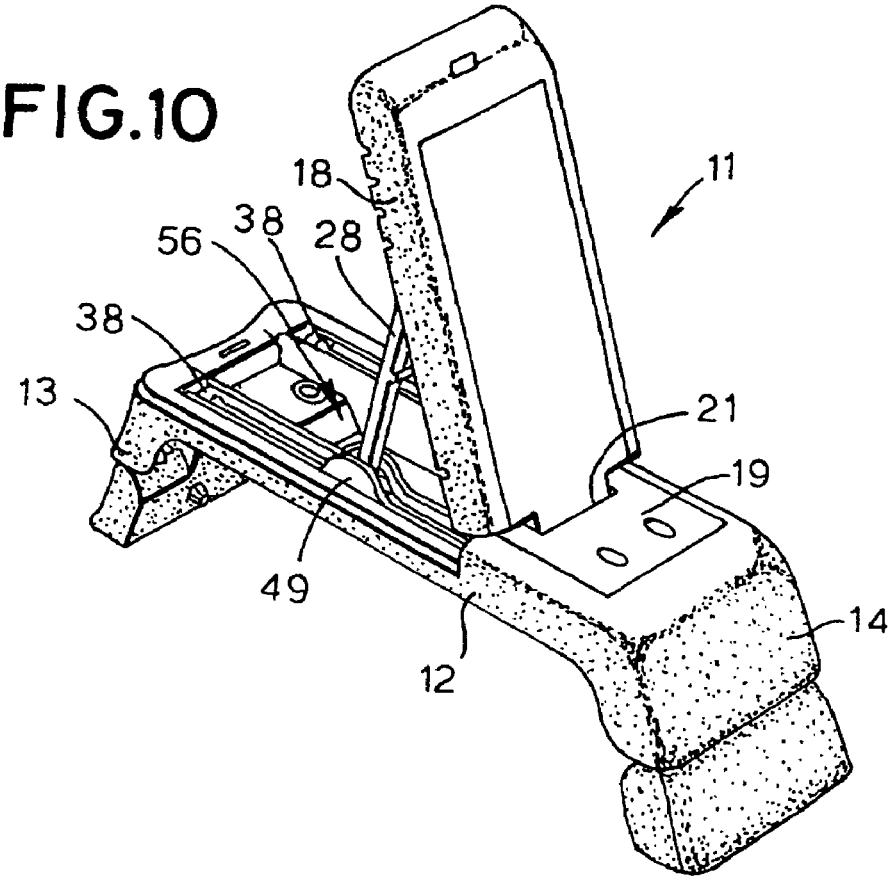
FIG. 10 shows a perspective view of the exercise apparatus arranged in its chair configuration, as in FIG. 9.

Referring now to FIGS. 9 and 10, there is shown the same exercise apparatus 11, as described above with reference to FIGS. 1 to 8, but now arranged in the chair configuration. In this configuration, the legs 13, 14 are again fully extended as in the bench and seated incline configurations. However, the back-rest element 18 is now fully rotated about its pivot point 21, and retained in position by the strut 28, such that said back-rest element 18 is now inclined at an angle of substantially 80° relative to the platform 12. With the exercise apparatus 11 arranged in this position, the user (not shown) again sits on the seat portion 19 and leans against the back-rest element 18, but will now be in an upright seated position rather than a reclining position.

Figure 11:
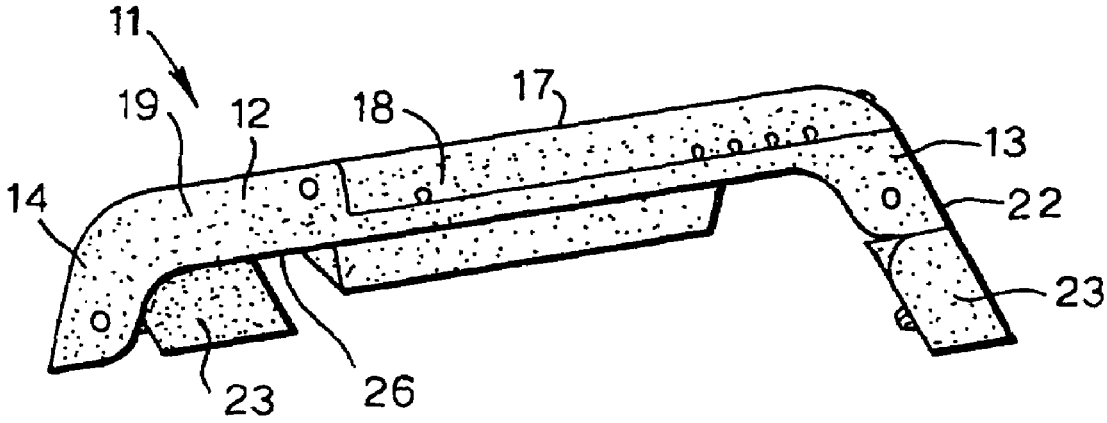
FIG. 11 shows a side view of the exercise apparatus of FIGS. 1 to 10, when arranged in its intermediate incline configuration.
Figure 12:
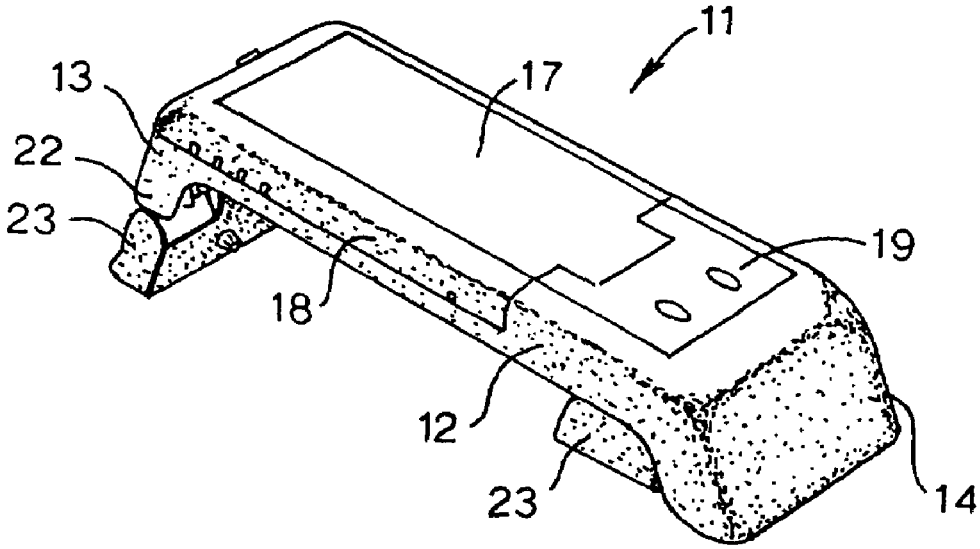
FIG. 12 shows a perspective view of the exercise apparatus arranged in its intermediate incline configuration, as in FIG. 11.

Referring now to FIGS. 11 and 12, there is shown again the same exercise apparatus 11 as described above with reference to FIGS. 1 to 10, but now arranged in an intermediate incline configuration. This configuration is similar to the bench configuration in that the back-rest element 18 is arranged in its first position, lying flush with the platform 12, such that the back-rest element 18 and the seat portion 19 again form a continuous upper surface 17 of the platform 12.

In this configuration, the first leg 13 is fully extended such that the lower portion 23 thereof is engaged with its respective upper portion 22. However, the second leg 14 is arranged in its folded position, such that the lower portion 23 lies alongside the underside 26 of the platform 12. The upper surface 17 of the platform 12, on which the user (not shown) will lie, is therefore arranged at an acute angle relative to the ground. It is of course possible also to achieve this intermediate incline configuration by having the second leg 14 fully extended and the first leg 13 folded.

Referring now to FIG. 13, there is again shown the same exercise apparatus 11, arranged in the chair configuration, as described above with reference to FIGS. 9 and 10. As can be seen from FIG. 13, the strut 28, which supports and retains the back-rest element 18 in position, comprises two support members 33 linked by two cross-linking members 34 provided perpendicularly thereto.

Each support member 33 is pivotably connected at its head 35 to the back-rest element 18 about a pivot point 36, whilst the foot 37 of each support member 33 is mounted for sliding motion along a guide track 38. By varying the position of the strut 28 along the guide track 38, the inclination of the back-rest element 18 relative to the platform 12 is varied, thus enabling the exercise apparatus to achieve its different configurations.

The strut 28 is connected to a spring-loaded mechanism 39, which in turn is connected to a handle 41 provided at the upper end 31 of the back-rest element 18. The handle 41 communicates with retaining means such as locking pins (not shown) provided at the feet 37 of the strut 28. The handle 41 can thus be used to release the strut 28 from one position in the track 38 and move it to another, thus varying the position of the back-rest element 18 relative to the platform. The handle 41 also has a latch 42 associated therewith, a complementary slot 43 being provided on the platform 12 adjacent the head 15 thereof. The handle 41 can thus also be used to unlock the back-rest element 18 from the platform 12 when lying flush therewith.

Figure 13:
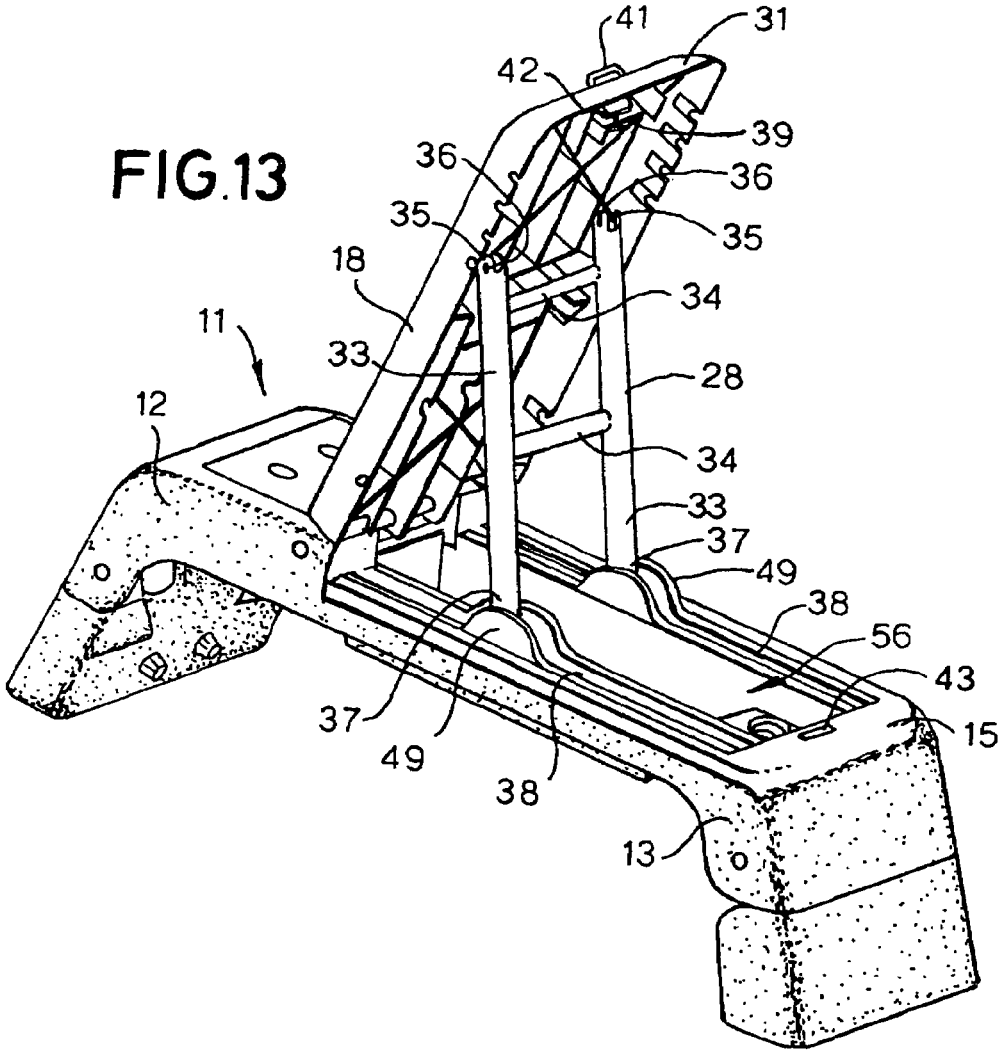
FIG. 13 is an alternative perspective view of the exercise apparatus arranged in its chair configuration, as in FIG. 10, showing a preferred construction of support means for the back-rest element.
Figure 14:
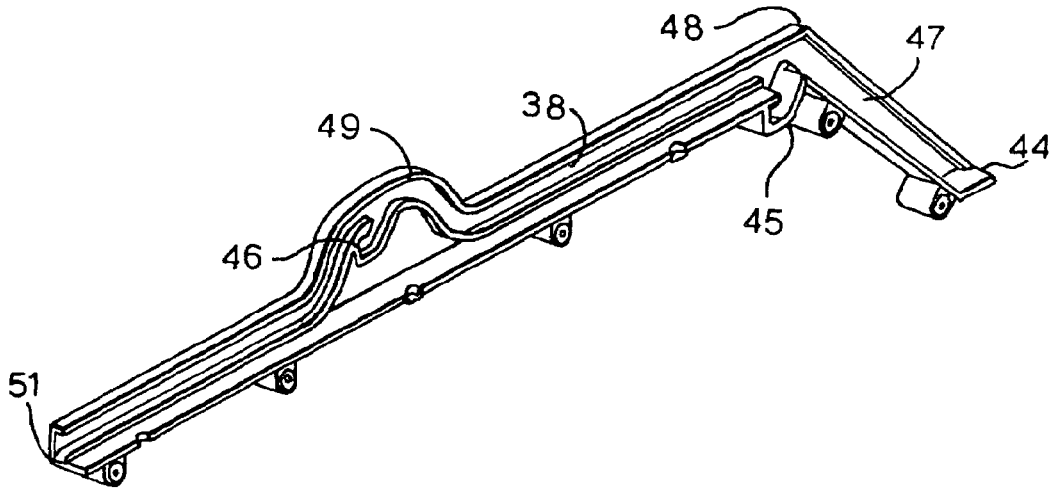
FIG. 14 shows a perspective view of a guide track for use as a component of the support means shown in FIG. 13.

Referring now to FIG. 14, there is shown a preferred construction of guide track 38 for use in the exercise apparatus 11 according to the present invention. As described above with reference to FIG. 13, a guide track 38 is provided at each side of the platform 12, parallel to the longitudinal axis thereof, and is adapted to receive a foot 37 of a strut support member 33 therein, mounted for sliding movement therealong.

In addition to the locking pins or other retaining means described above with reference to FIG. 13, the feet 37 may also be retained at desired locations along the track 38 by means of a series of detent positions 44-46. As can be seen from FIG. 14, the first detent position 44 is at a lower level than the remainder of the guide track 38, and lies at the end of a depending portion 47 of said guide track 38. This depending portion 47 is housed within the first leg 13 of the exercise apparatus 11, as will be seen from FIGS. 15 to 18.

The second detent position 45 is provided adjacent the junction 48 of the depending portion 47 with the main part of the guide track 38, and this position corresponds to the head 15 of the platform 12.

The third detent position 46 is provided on a raised portion 49 of the guide track 38, which is clearly visible when the back-rest element 18 is raised, as shown for example in FIGS. 9, 10 and 13.

The foot 37 of each strut support member 33 is also permitted to travel to the end 51 of each guide track 38, which position corresponds to the boundary between the back-rest element 18 and the seat portion 19, closely adjacent the pivot point 21 for the back-rest element 18.

The positioning of the strut 28 in the guide track 38 and its effect on the positioning of the back-rest element 18, will now be described with reference to FIGS. 15 to 18.

Figure 15:
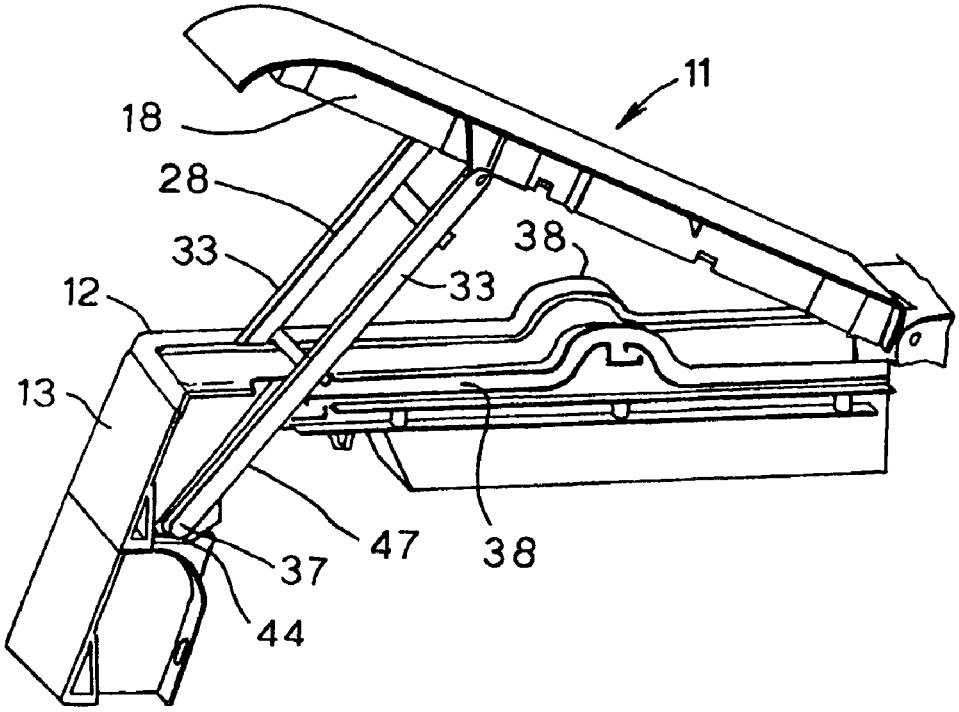

Referring first to FIG. 15, the exercise apparatus 11 is shown with the feet 37 of the strut 28 located at the first detent position 44. The strut support members 33 thus descend into the depending portion 47 of each guide track 38, housed within the first leg 13 of the platform 12. With the strut 28 in this position, the back-rest element 18 is inclined at an angle of substantially 30° relative to the platform 12, as is required for the low seated incline configuration.

Figure 16:
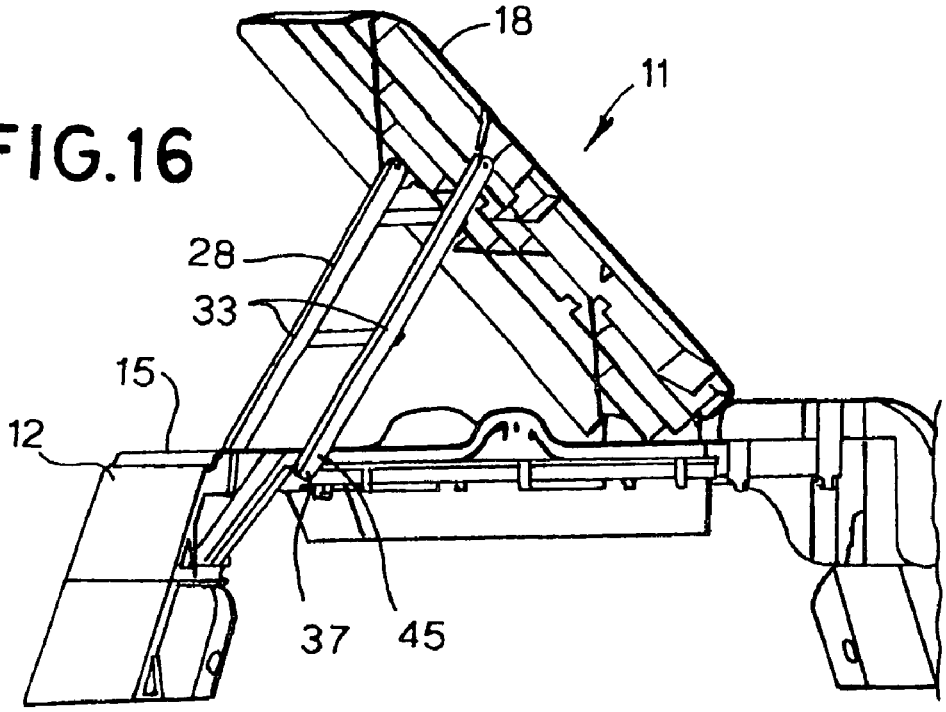

Referring now to FIG. 16, the strut 28 has now been moved along the guide tracks 38 such that its feet 37 are now located at the second detent position 45, adjacent the head 15 of the platform 12. The full length of the strut support members 33 is now utilised, thus increasing the angle between the back-rest element 18 and the platform 12 to substantially 60°, as is required for the high seated incline configuration.

FIG. 17 shows the strut 28 moved further along the guide tracks 38, such that the feet 37 thereof are located in the third detent position 46 provided on the raised portion 49 of the guide track 38. The strut 28 is thus both raised and brought closer to the pivot point 21 of the back-rest element 18, thus increasing the angle between the back-rest element 18 and the platform 12 to substantially 80°, as is required for the chair configuration.

The positioning of the raised portion 49 of the guide track 38 ensures that movement of the feet 37 of the strut 28 beyond the third detent position 46 does not cause any further increase in the angle between the back-rest element 18 and the platform 12. Instead, as is shown in FIG. 18, the strut 28 tucks underneath the back-rest element 18 by rotating about its pivot point 36. As the feet 37 are slid to the end 51 of the guide track 38, the strut support members 33 are brought substantially parallel with the back-rest element 18, which is itself brought into registration with the platform 12 to lie flush therewith. The exercise apparatus thus assumes its bench configuration.

Referring now to FIG. 19, there is shown a preferred construction of locking means, by which the lower portion 23 of each leg 13, 14 may be held in its folded position as required in the step and intermediate incline configurations.

The locking means comprises a protruding stud 52 provided on the underside 26 of the platform 12, and a complementary hole 53 provided in the lower portion 23 of the leg 13. The stud 52 engages with the hole 53 in a snap-fitting arrangement.

Alternatively, as shown for example in FIG. 1, the stud 52 may be provided on the lower leg portion 23 and the hole 53 may be provided in the underside 26 of the platform 12.

Referring again to FIG. 19, it can be seen that the lower leg portion 23 is also provided with a tab 54 engageable with a complementary notch 55 provided on the upper leg portion 22. The tab 54 and notch 55 engage in a snap-fitting arrangement to retain the leg 13 in its extended position as required for the bench, incline and chair configurations.

As can be seen best from FIGS. 9, 10 and 13, the exercise apparatus 11 is also provided with a storage compartment 56 in the platform 12. The storage compartment 56 is accessed by rotating the back-rest element 18 to its 80° (chair configuration) position. The back-rest element 18 thus also acts as a lid for the storage compartment 56, which may be used to store fitness accessories such as the elastic resistance bands intended for use with the exercise apparatus 11, as well as hand weights (dumb bells) and the like.

The upper surface 17 of the exercise apparatus 11 may be provided with a rubberised finish. This provides a resilient surface to enable the safe performance of step aerobics exercises when the exercise apparatus 11 is arranged in the step configuration, but also provides the user with some degree of comfort when sitting or lying on the apparatus 11 when arranged in the bench, chair, seated incline or intermediate incline configurations.

Additional features of the exercise apparatus 11 of the present invention, which facilitate the performance of exercise thereon may include the provision of handle grips (not shown) at the head 15 and foot 16 of the platform 12, located in the upper portions 22 of the first and second legs 13, 14 respectively, and at the upper end 31 of the back-rest element 18. These would enable the user to hold on to the apparatus 11 for the performance of certain exercises where additional stability is required, for lifting and carrying the apparatus from one place to another, and for stabilising the apparatus when manipulating it from one configuration to another.

The invention claimed is:

1. Exercise apparatus comprising:

an elongate platform having a head end and a foot end, and a surface adapted to accommodate a user lying in a recumbent position thereon;

a leg of adjustable length adjacent each said end of said platform;

a track provided in said platform, parallel to a longitudinal axis of the platform, and comprising a main portion and a depending portion angled relative to said main portion and housed at least partially within said leg adjacent said head end, a junction being formed in the track between the main portion and the depending portion;

a back-rest element pivotally mounted in the platform at a point intermediate its ends, which back-rest element is capable of rotation between a first position wherein it lies flush with the platform surface, a second position wherein it is inclined relative thereto; and at least one transitional position therebetween, wherein said track is completely enclosed by said platform and said back-rest when said back-rest is in the first position;

means for adjusting and retaining said back-rest element in said first, second and transitional positions, said means comprising a strut, having a head pivotably connected to the underside of the back-rest element, and a foot slidably received in said track, such that said strut is raised and lowered at certain points of said track;

wherein by adjustment of at least one of the legs and rotation of the back-rest element between its first, second and transitional positions, the apparatus is capable of being re-arranged to form each member of a range of alternative configurations comprising bench, chair, seated incline, intermediate incline and step configurations.

2. Exercise apparatus as claimed in claim 1, wherein the back-rest element is capable of being retained in a range of positions corresponding to a range of angles comprising 0°, at least one of 30° and 60°, and at least one of 80° and 90°, relative to the platform.

3. Exercise apparatus as claimed in claim 1 wherein the strut comprises two support members, each having a head pivotably connected to the underside of the back-rest element, and a foot slidably received in said track provided in the platform, a separate track being provided for each support member.

4. Exercise apparatus as claimed in claim 3, wherein the strut further comprises at one least cross-linking member extending perpendicularly between the support members.

5. Exercise apparatus as claimed in claim 1, further comprising means for retaining said foot of the strut at a series of selected locations along said track, corresponding to the range of positions attainable by the back-rest element, said foot retention means comprising a series of detent positions provided along the length of the track, corresponding to said selected locations.

6. Exercise apparatus as claimed in claim 5, wherein at least one detent position is provided on said depending portion of the track and at least one detent position is provided on said main portion of the track.

7. Exercise apparatus as claimed in claim 5, wherein the foot retention means further comprises locking pins provided at said foot of the strut, adapted to engage with complementary recesses at selected locations in the track.

8. Exercise apparatus as claimed in claim 1, wherein the adjusting and retaining means comprises a spring-loaded mechanism.

9. Exercise apparatus as claimed in claim 8, wherein said spring-loaded mechanism is operable by a handle provided on the back-rest element, said handle also operating a locking mechanism by means of which the back-rest element engages with the platform.

10. Exercise apparatus as claimed in claim 1, wherein each leg comprises an upper portion formed integrally with the platform, and a lower portion pivotably connected to the platform.

11. Exercise apparatus as claimed in claim 10, wherein the lower portion of each leg is pivotable between a first folded position wherein said lower portion lies alongside the platform and substantially parallel thereto, and a second unfolded position wherein said lower portion engages with the upper portion of the leg, thereby to increase the length of the leg.

12. Exercise apparatus as claimed in claim 1, wherein:

a first detent position is located at the end of said depending portion;

a second detent position is located adjacent said junction; and a third detent position is located on the main portion of the track provided part-way along the platform.

* * * * *